US005201410A

United States Patent [19]

Takano et al.

[11] Patent Number: 5,201,410

[45] Date of Patent: Apr. 13, 1993

[54] PUSH-BUTTON SWITCHES

[75] Inventors: Tsunesuke Takano; Kouichi Sinzawa, both of Tokyo, Japan

[73] Assignee: Daichi Denso Buhin Co., Ltd., Tokyo, Japan

[21] Appl. No.: 756,857

[22] Filed: Sep. 11, 1991

[30] Foreign Application Priority Data

Sep. 12, 1990 [JP] Japan ..... 2-95889[U]

[51] Int. Cl.[5] ..... H01H 13/12; H01H 13/14

[52] U.S. Cl. ..... 200/531; 200/530; 200/532; 200/252

[58] Field of Search ..... 200/531, 530, 532, 534, 200/535, 536, 252, 257, 260, 345, 520, 341

[56] References Cited

U.S. PATENT DOCUMENTS 3,142,742 7/1965 Kaleba et al. ..... 200/531
4,689,454 8/1987 Schulte et al. ..... 200/531
5,063,277 11/1991 Takano et al. ..... 200/531

FOREIGN PATENT DOCUMENTS 63-82327 11/1986 Japan .

*Primary Examiner*—Henry J. Recla
*Assistant Examiner*—David J. Walczak
*Attorney, Agent, or Firm*—Nixon & Vanderhye

[57] ABSTRACT

Push-button switches are provided with a housing having opposed pairs of side walls defining an interior space, and an opposed pair of fixed contact members. A push-button assembly is received within the interior space of the housing for reciprocal movements between extended and retracted positions. The push-button assembly including a pair of opposed side windows having lower extents established by a bridge wall. A spring exerts a bias force to move the push-button assembly into its extended position. A generally inverted V-shaped slide contact member is movable with the push-button assembly between its extended and retracted positions, and includes a pair of resilient legs each having an outwardly curved contact region. The contact regions serve to contact the pair of fixed contact members when the push-button assembly is moved into one of its extended and retracted positions whereby an electrical circuit is made, and breaks contact with at least one of the fixed pair of contacts when the push-button assembly is moved into the other of its extended and retracted positions, whereby an electrical circuit is broken. The slide contact member further includes terminal end flanges extending from the curved contact regions, the terminal end flanges being positioned so as to contact a respective bridge wall of an associated side window and thereby limit the extent of outward resilient displacement of the legs of the slide contact member.

8 Claims, 9 Drawing Sheets

PUSH-BUTTON SWITCHES

FIELD OF INVENTION

The present invention relates generally to push-button switches so as to make and break electrical circuits. More specifically, the present invention relates to push-button switches that are relatively easily assembled.

BACKGROUND AND SUMMARY OF THE INVENTION

A conventional push-button switch is known from published Japanese Examined Utility Model No. 63-82327. In this connection, the push-button switch disclosed therein includes a switch body which has a front attachment plate formed of an electrically insulating material and a central hollow portion in which the shaft of the operation button may be slidably inserted. The operation button includes a primary fixed contact member and is inserted into one end of the switch body. The operation button is positionally restrained within the switch body by means of a pair of contact member insertion holes formed on the switch body's exterior. A secondary fixed contact is inserted into an opposite end of the switch body. The operation button protrudes beyond the switch and is resiliently maintained within the switch body by a movable contact member which is fixed onto the end of the operation button and includes a pair of resilient conducting pieces. The resilient conducting pieces are disposed so that contact is made at the contact point between the primary and secondary fixed contact members.

One problem associated with conventional push-button switches of the structure as described above is that the operation button is not positionally restrained during assembly, thereby making the assembly operation more tedious and/or difficult. According to the present invention, however, a push-button switch is provided which is relatively easily assembled as compared to typical push-button switches of the prior art.

In this connection, the push-button switches of the present invention are provided with a housing having opposed pairs of side walls defining an interior space, and an opposed pair of fixed contact members. A push-button assembly is received within the interior space of the housing for reciprocal movements between extended and retracted positions. The push-button assembly includes a pair of opposed side windows having lower extents established by a bridge wall. A spring exerts a bias force to move the push-button assembly into its extended position.

A generally inverted V-shaped slide contact member is movable with the push-button assembly between its extended and retracted positions, and includes a pair of resilient legs each having an outwardly curved contact region The contact regions serve to contact the pair of fixed contact members when the push-button assembly is moved into one of its extended and retracted positions whereby an electrical circuit is made, and breaks contact with at least one of the fixed pair of contacts when the push-button assembly is moved into the other of its extended and retracted positions, whereby an electrical circuit is broken.

The slide contact member further includes terminal end flanges extending from the curved contact regions, the terminal end flanges being positioned so as to contact a respective bridge wall of an associated side window and thereby limit the extent of outward resilient displacement of the legs of the slide contact member. As a result of this limited outward displacement, the slide contact member may be temporarily (but securely) positioned within the push-button assembly so as to facilitate automated coupling of the push-button assembly and the housing during fabrication.

Further aspects and advantages of this invention will become more clear after careful consideration is given to the detailed description of the preferred exemplary embodiments thereof which follow.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIGS. 1A and 1B each represent exploded cross-sectional elevational views of respective embodiments of a push-button switch according to this invention;

DETAILED DESCRIPTION OF THE PREFERRED EXEMPLARY EMBODIMENTS

Figure 1A:
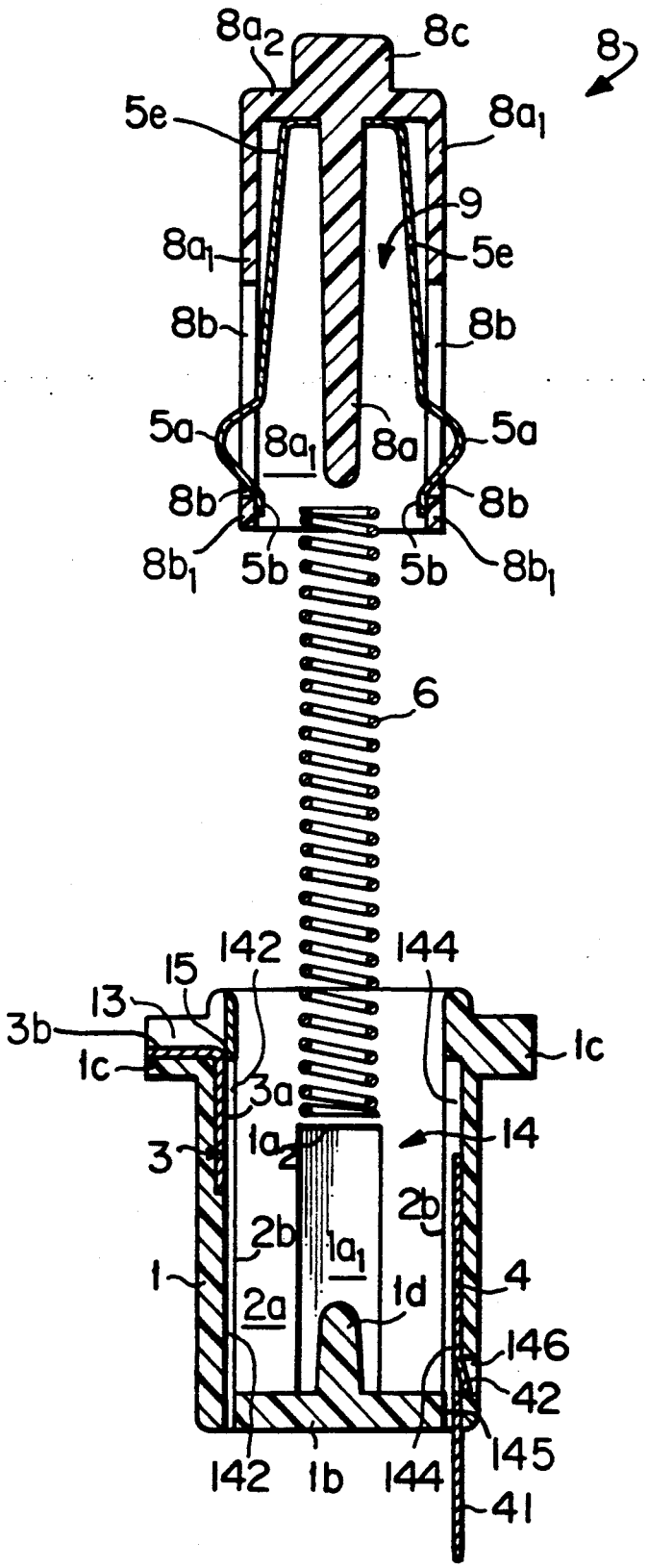

The push-button switch embodiment depicted in accompanying FIG. 1A is provided with an open-ended push-button housing 1 which is preferably formed of an electrically insulating plastics material. The housing 1 is includes opposed pairs of inner walls **2*a* and 2*b* which collectively establish an interior space 14 which is sized and configured to receive the pushbutton assembly 8. The bottom end of the housing 1 is closed by a bottom wall 1*b* having an integral centrally disposed, upwardly extending post 1*d* which is sized and configured so as to be inserted into one end of compression spring 6. Lateral mounting flanges 1*c* are preferably provided near the open upper end of the housing 1** so as to facilitate mounting of the housing (and hence the push-button switch) to underlying support structure (not shown).

The inner walls 2a of the housing 1 include longitudinal recesses $1a_1$ which define a generally transverse (relative to the longitudinal dimension of the housing 1) edge $1a_2$. The edges $1a_2$ associated with each of the recesses $1a_1$ provide a stop surface against which respective ones of the locking tabs 7 (see FIG. 2A) contact so as to establish an upper limit of travel of the push-button assembly 8 within the housing 1.

The other pair of inner walls 2b is provided with longitudinally extending grooves 142 and 144 which are adapted to receive the fixed contact members 3 and 4, respectively. The fixed contact members 3, 4 are each preferably an electrically conductive strip of metal. The fixed contact member 3 is generally bent at right angles and includes one leg 3a which extends through an insertion hole 15 within the groove 142, and another leg 3b which extends outwardly from the housing 1 within a recess fixed contact 4 extends through the insertion hole 145 formed in the bottom wall 1b of the housing 1 and is positionally locked within the groove 144 by means of resilient locking tab 42 thereof extending into the locking aperture 146. The fixed contacts 3 and 4 are thus arranged so as to be in opposition to one another within the interior space 14 of housing 1.

Figure 2A:
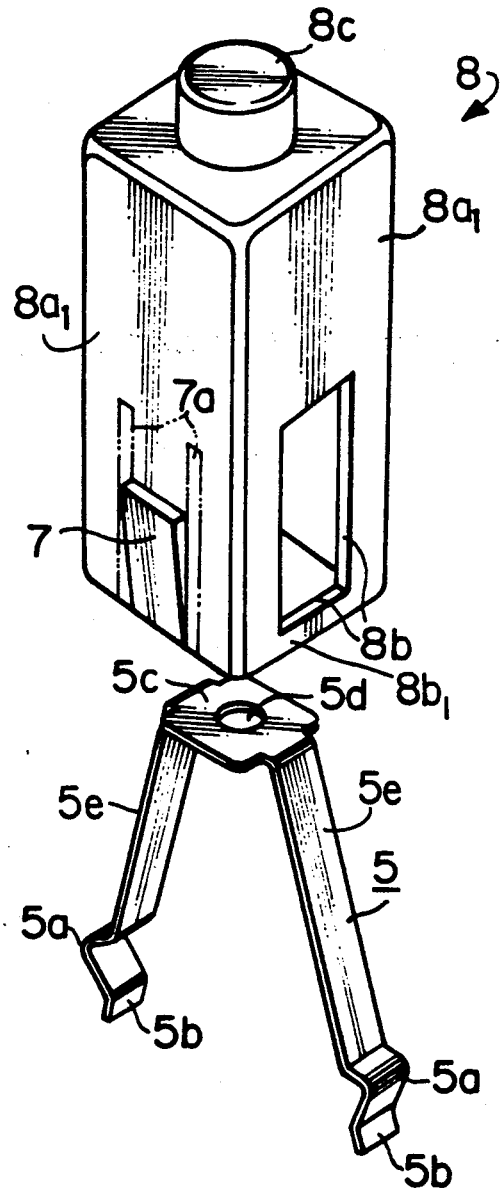
FIGS. 2A and 2B are top perspective views showing the operation button and the resilient movable contact piece in separated relationship which are associated with the push-button switch embodiments of FIGS. 1A and 1B, respectively.

The push-button assembly 8 is perhaps best seen in accompanying FIG. 2A. As shown, the push-button assembly 8 includes opposed pairs of elongate side walls $8a_1$ which establish an interior region 9 which is closed at the upper end by means of upper wall $8a_2$. The upper wall 8a, is further provided with an integral outwardly protruding boss 8c, and an inwardly (i.e., within interior region 9) extending post 8a. Post 8a is coaxially opposed to the post 1d associated with the bottom wall lb of housing 1, and is sized and configured so as to be inserted into the upper end of spring 6. Thus the posts 1d and 8a serve to positionally retain the spring 6 within the push-button switch.

The push-button assembly 8 includes a slide contact member 5 which is generally in the form of an inverted V and is formed of an electrically conductive strip of metal (e.g., phosphor bronze or the like). The slide contact member 5 includes a base 5c which defines a hole 5d which is sized to allow the post 8a to be inserted therewithin during assembly and thereby to allow the base 5c to be positioned adjacent the upper wall 8a: as shown in FIG. 1A. A pair of resilient contact arms 5e extend downwardly and outwardly from the base 5c. The contact arms 5e include outwardly curved contact regions 5a which are adapted to bear against respective one of the fixed contacts 3 and 4. A terminal end flange 5b extends downwardly from the curved regions 5a.

A window 8b is formed in an opposed pair of side walls $8a_1$ of the push-button assembly 8 so as to allow the curved contact regions 5a of the slide contact 5 to protrude outwardly therefrom and thus contact their respective fixed contact 3 or 4. During assembly of the push-button switch, the slide contact member 5 may be locked temporarily in position by means of the terminal end flanges 5b of the slide contact member 5 resiliently bearing against the inner surface of the bridge wall $8b_1$ which defines the lower extent of the window 8b as shown specifically in FIG. 1A. In this position, therefore, the curved contact regions 5a will protrude outwardly through the windows 8b.

The spring 6 may be positionally restrained during assembly by inserting its lower end over the post 1d associated with the housing 1. The push-button assembly 8 may then be coupled operatively to the housing 1 by inserting the post 8a into the upper end of the spring 6 and then pushing the assembly 8 against the force of the spring 8 into the interior space 14 of housing 1. As can be appreciated, the initial insertion of the push-button assembly into the housing 1 causes the locking tabs to be resiliently inwardly displaced until they extend below the edge stop $1a_2$ formed in wall 2a, at which time the lock tabs return to their normal condition which is accommodated by recess $1a_1$. Thereafter, the force of the spring 6 will urge the push-button assembly into a normal state in which the lock tabs 7 bear against the edge stop $1a_2$. As a result, the push-button assembly 8 is maintained within the housing 1.

Although the side walls $8a_1$ of the push-button assembly 8 have sufficient inherent resiliency so as to allow the lock tabs 7 to "click" forcibly into the recesses $1a_1$ during assembly of the push-button switch as described above, the resiliency of the lock tabs 7 can be enhanced by providing a relief slots 7a on both sides of the lock tabs 7 as shown in FIGS. 2A.

Figure 3A:
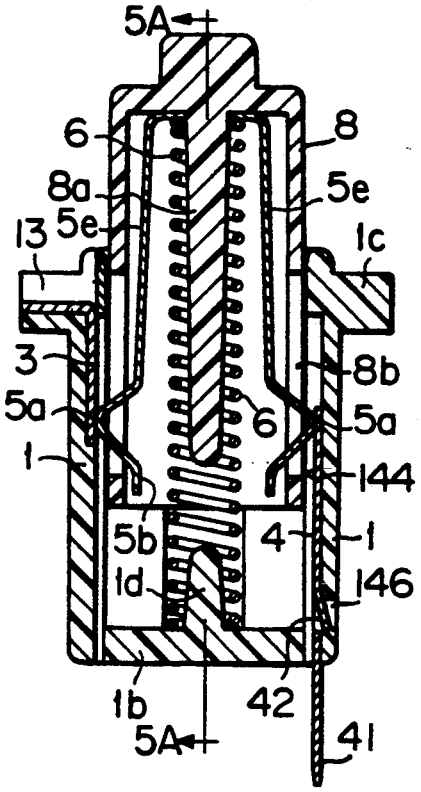
FIGS. 3A and 3B are respective cross-sectional elevational views of the push-button switch embodiments shown in FIGS. 1A and 1B and depicted in an "on" state.
Figure 4A:
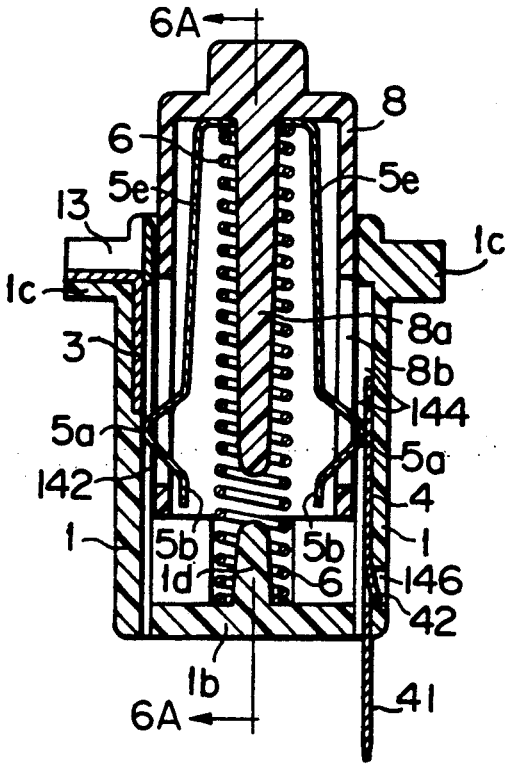
FIGS. 4A and 4B are respective cross-sectional elevational views of the push switch embodiments shown in FIGS. 1A and 1B and depicted in an "off" state.
Figure 5A:
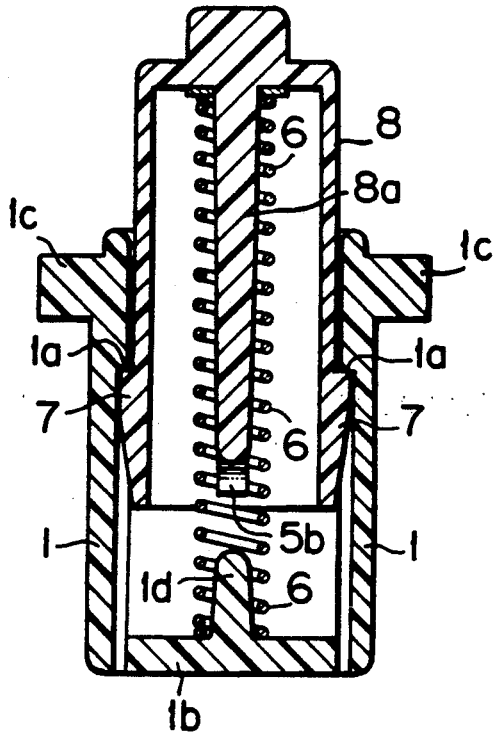
FIGS. 5A and 5B are respective cross-sectional elevational views of the push-button switch embodiments depicted in FIGS. 3A and 3B as taken along lines 5A—5A and 5B—5B therein.

The operation of the push-button switch as described above will become more clear after consideration is given to accompanying FIGS. 3A, 4A, 5A and 6A. The "on" state of the switch is shown in FIGS. 3A and 5A. As is seen, the "on" state of the switch is the outwardmost extent of travel of the push-button assembly 8 that is established by the lock tabs 7 and edge stops 1b (see FIG. 5A). Furthermore, it will be observed in FIG. 3A that the curved contact regions 5a of the slide contact member 5 each contact a respective one of the fixed contact members 3 and 4.

If, for example, the push-button switch is employed as a door light switch for an automobile whereby the fixed contact member 3 is connected electrically to the negative battery terminal of the automobile and the plug piece 41 of the fixed contact 4 is connected electrically to the positive battery terminal of the automobile via the dome light (indicating that a door of the automobile is opened), the dome light will be illuminated when the push-button assembly is in the state shown in FIGS. 3A and 5A. Upon closure of the automobile door, however, the push-button assembly 8 will be depressed within the interior space of the housing 1 against the bias force of the spring 6, which in turn causes one of the curved contact regions 5a to move beyond the terminal end of fixed contact member 3 and onto the electrically insulting groove 142. As a result, the dome light circuit is broken and the dome light is extinguished. This "off" state of the switch is depicted in accompanying FIGS. 4A and 6A. Of course, opening the automobile door again will cause the push-button assembly to be urged outwardly by the bias force of spring 6 at which time the curved contact regions 5a again are in contact with the fixed contacts 3 and 4 so that the circuit to the dome light is again made and the dome light again illuminated.

It will be observed, for example in FIGS. 3A and 4A, that the legs 5e of the slide contact member 5 will be inwardly flexed when the push-button assembly 8 is operatively seated within the housing 1 by virtue of the curved contact regions 5a coming into contact with the fixed contacts 3 and 4 to an extent that the slide contact member 5 assumes a generally inverted U-shaped configuration. The terminal end flanges 5b will likewise be inwardly displaced from their respective bridge walls $8b_1$, but the inherent bias force of the legs 5e of the slide contact member 5 will urge the terminal end flanges 5*b* in a direction towards the bridge walls $8b_1$. Thus, the bridge walls $8b_1$ serve as a limit stop to establish the extent of outwardly lateral displacement of the legs 5*e* which, as noted previously, greatly assists during the assembly phase of the push-button switch.

Figure 1B:
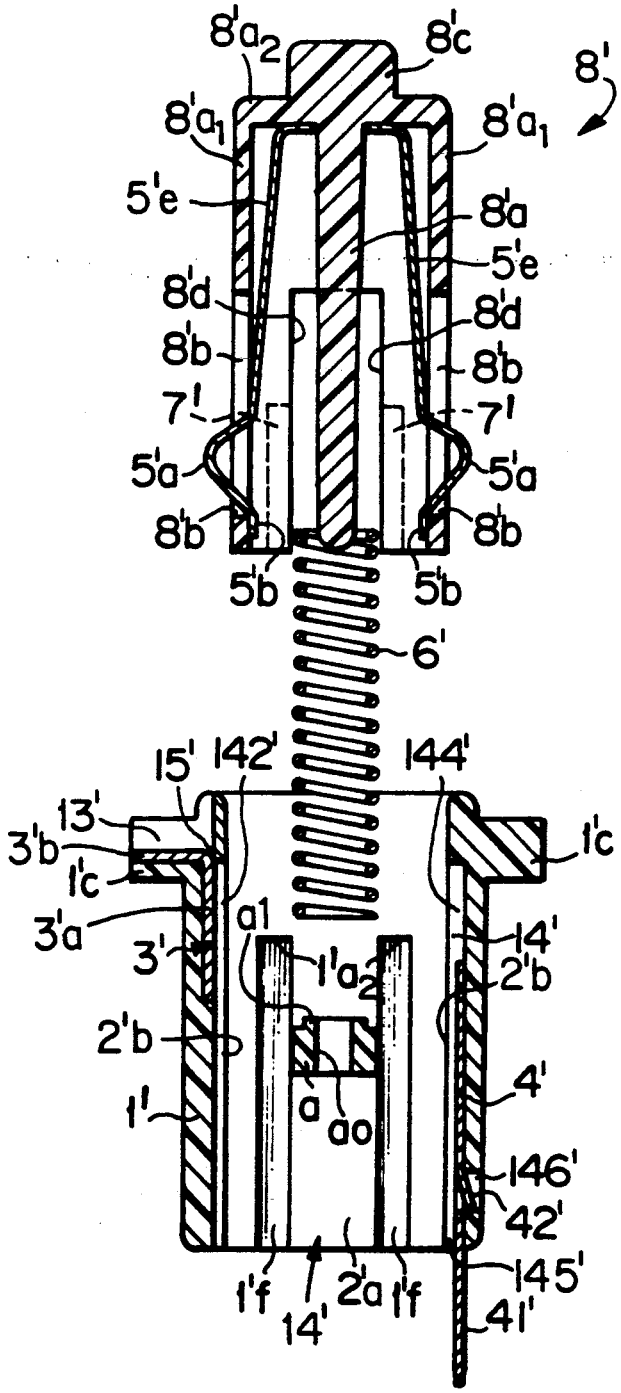

Another embodiment of the push-button switch according to this invention is depicted generally in accompanying FIG. 1B. In this connection, those structures which are substantially identical to the structures discussed previously with regard to the embodiment shown in accompanying FIG. 1A have been labelled with the same reference numeral but additionally, have been provided with a prime (') designation. Therefore, since it is unnecessary to again discuss structures which are common to the embodiment of FIGS. 1A and 1B, the discussion which follows will focus upon those structures which are substantially different.

It will be noted in this regard, that the housing 1' of the push-button switch shown in FIG. 1B essentially differs from the housing 1 discussed previously in connection with FIGS. 1A in that it does not include a bottom wall. Instead, the housing 1') of the push-button switch shown in FIG. 1B includes a transversely positioned (relative to the longitudinal dimension of the housing 1') support web a (see FIGS. 5B and 6B). The support web a extends between the opposed pair of side walls 2'*a* and defines a central guide aperture ao which is coaxially aligned with the post 8'*a* of the push-button assembly 8. In addition, the support web a includes an annular boss al surrounding the guide aperture ao in opposition to the post 8'*a* of the push-button assembly 8. The ring boss al is sized and configured to be inserted within the lower end of spring 6' and thus serves to positionally restrain the spring 6' within the interior space 14' of the housing 1'.

Figure 2B:
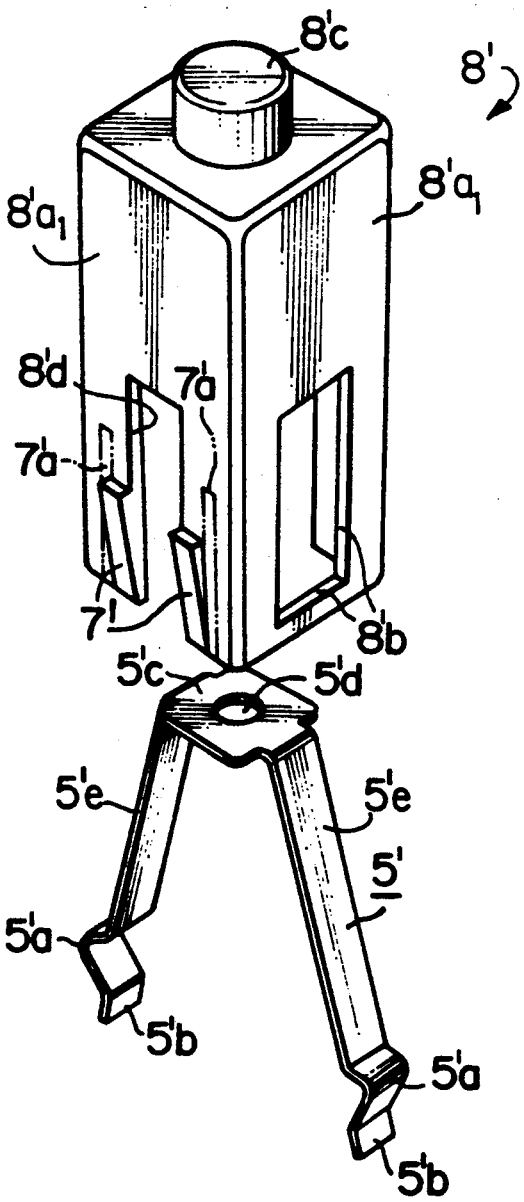

The push-button assembly includes a cut-out opening 8'*d* which allows the walls $8'a_1$ to straddle the support web a when the push-button assembly 8' is assembled with the housing 1' as well as during use of the push-button switch to accommodate reciprocal movements of the push-button assembly 8' within the interior space 14' of housing 1'. As is perhaps best seen in FIG. 2B, a pair of lock tabs 7' are formed on the lower end of the walls $8'a_1$ adjacent the opening 8'*d*. The lock tabs 7' cooperate with a respective one of the stop edges $1'a_2$ formed at the upper end of recesses 1'*f* in the walls 2'*a* of the housing 1'. Contact between the lock tabs 7' and the edge stops $1'a_2$ serve to limit the upwardmost extent of the push-button assembly 8' relative to the housing 1'.

Figure 3B:
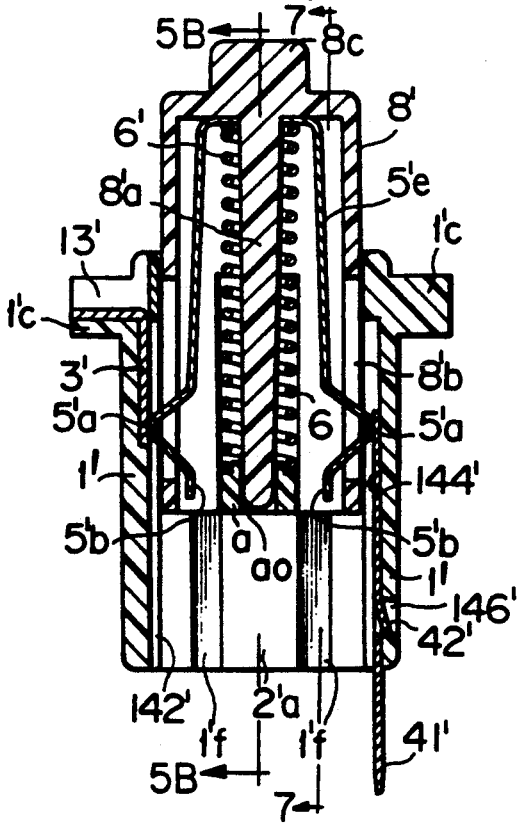
Figure 4B:
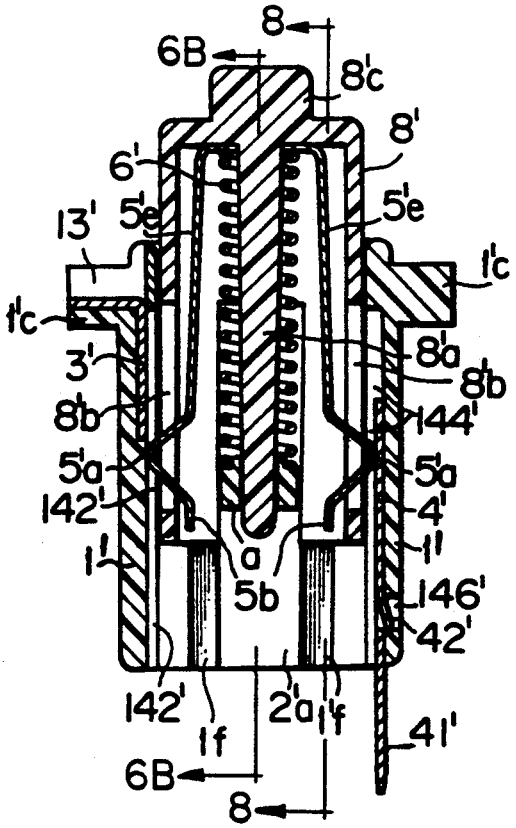
Figure 5B:
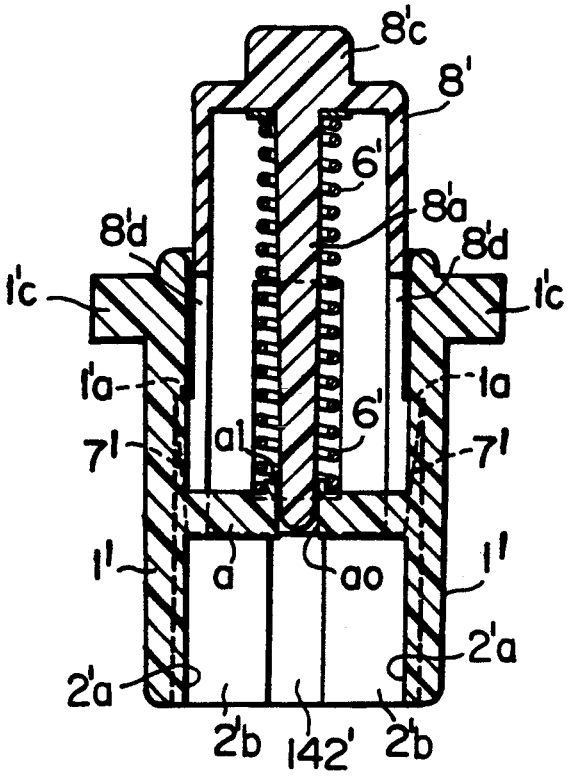
Figure 6A:
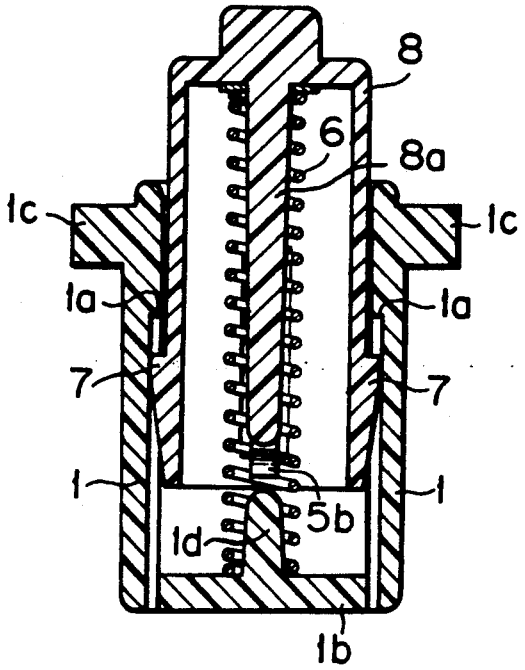
FIGS. 6A and 6B are respective cross-sectional elevational views of the push-button switch embodiments depicted in FIGS. **4*a* and 4B as taken along lines 6A—6A and 6B—6B** therein.
Figure 6B:
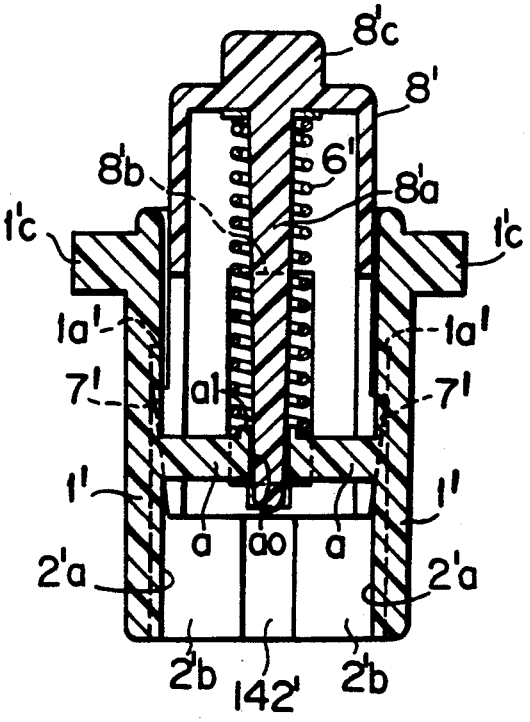
Figure 7:
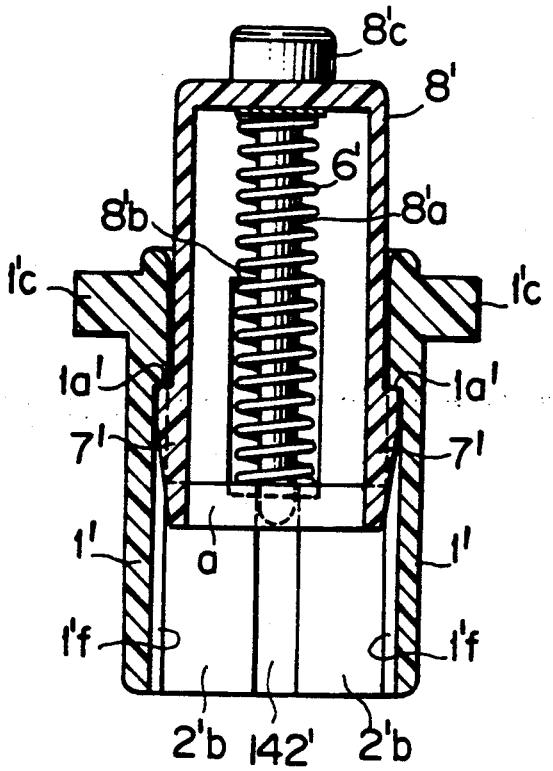
FIG. 7 is a cross-sectional elevational view of the push-button switch embodiment depicted in FIG. 3B as taken along line 7—7 therein.
Figure 8:
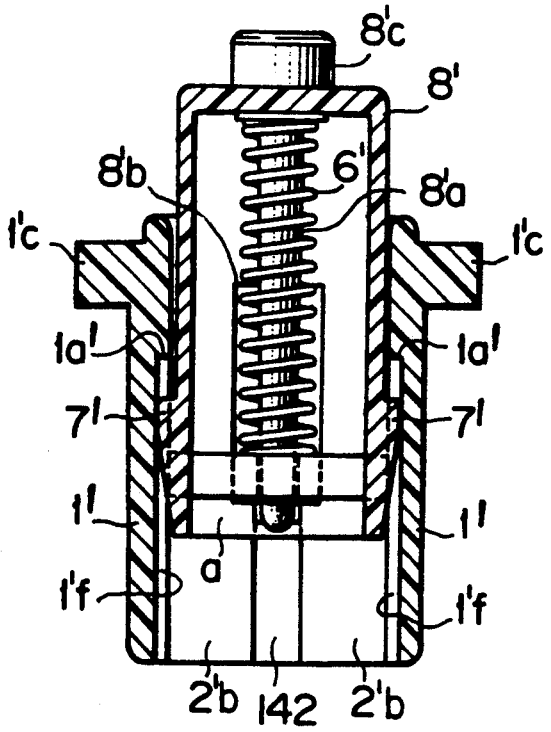
FIG. 8 is a cross-sectional elevational view of the push-button switch embodiment depicted in FIG. 4B as taken along line 8—8 therein.

The post 8'*a* of the push-button assembly 8' is of sufficient length such that its terminal end is positioned within the guide aperture ao when the switch is in an "on" state as can be seen in FIGS. 3B, 5B and 7. Thus, when the push-button assembly is moved within the interior space 14' of the housing 1' so as to assume its "off" state as shown in FIGS. 4B, 6B and 8, the post 8'*a* will further extend through and beyond the guide aperture ao. This cooperation between the post 8'*a* and the guide aperture ao thus serves to further positionally restrain the push-button assembly 8' within the interior space 14' of the housing 1'. Furthermore, The post 8'*a* and the guide aperture ao provide a convenient centering means during fabrication of the push-button switch to thereby facilitate automated (i.e., using robotic assistance) assembly operations.

Figure 9:
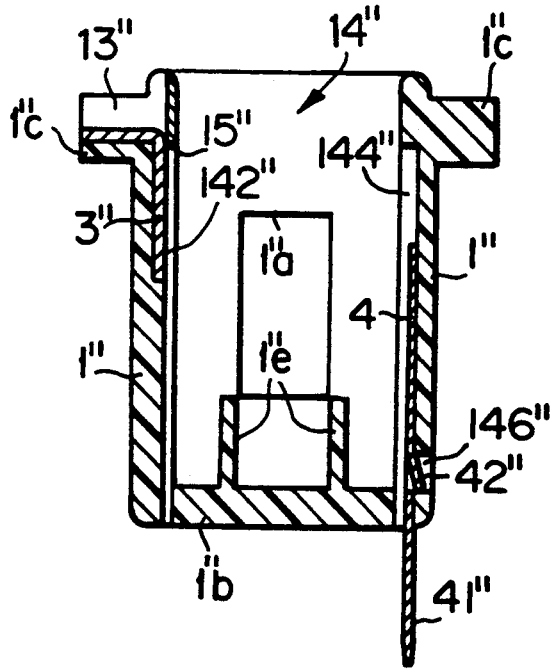
FIG. 9 is a cross-sectional elevational view of another embodiment of a cylindrical push-button housing that may be employed in the push-button switches according to the present invention.

An alternative housing 1" that may be employed in the push-button switches of this invention is shown in accompanying FIG. 9. Again, since many of the structures associated with the housing shown in FIG. 9 are common to the structures of the housings described above, similar reference numerals have been employed for purposes of this discussion, but have been designated with double-primes ("). As is seen, a principal difference between the housing 1" shown in FIG. 9 and the housing 1 shown, for example, in FIG. 1A, is that the bottom wall 1*b*" is provided with an integral cylindrical seat 1"*e* which is sized and configured to accept therewithin a lower end portion of the spring (not shown in FIG. 9, but see FIGS. 1A and 1B). That is, the cylindrical seat 1"*e* is provided so as to surround the lower end of the spring and thereby positionally restrain the same within the interior space 14" of the housing 1".

While the invention has been described in connection with what is presently considered to be the most practical and preferred embodiment, it is to be understood that the invention is not to be limited to the disclosed embodiment, but on the contrary, is intended to cover various modifications equivalent arrangements included within the spirit and scope of the appended claims.

What is claimed is:

1. A push-button switch comprising:

a housing having opposed pairs of side walls defining an interior space, and including an opposed pair of fixed contact members;

a push-button assembly which is received within said interior space of said housing for reciprocal movements between extended and including a pair of opposed side windows having lower extents established by a bridge wall; and a spring said push-button assembly includes a support post and for exerting a bias force to move said push-button assembly into said extended position thereof; wherein said push-button assembly includes a slide contact member which is movable with said push-button assembly between said extended and retracted positions, said slide contact member having a pair of resilient legs each having an outwardly curved contact region which protrudes through a respective one of said side windows for contacting a respective one of said pair of fixed contact members when said push-button assembly is moved into one of said extended and retracted positions whereby an electrical circuit is made, and for breaking contact with at least one of said fixed pair of contacts when said push-button assembly is moved into another of said extended and retracted positions, whereby an electrical circuit is broken, and wherein said slide contact member further includes terminal end flanges extending from said curved contact regions, said terminal end flanges being positioned so as to contact a respective one of said bridge walls associated with said side windows and thereby limit the extent of outward resilient displacement of said legs of said slide contact member.

2. A push-button switch as in claim 1, wherein is mounted on said bottom wall and is said housing includes a bottom wall, and an upwardly directed mounting post in coaxially opposition to said support post of said push-button assembly, said mounting post being inserted into a lower end of said spring.

3. A push-button switch as in claim 1, wherein said push-button assembly includes a support post, and said housing includes a transverse support web which defines a guide aperture coaxially disposed relative to said support post.

4. A push-button switch as in claim 3, wherein said support post is of sufficient length so as to be inserted within said guide aperture in said extended and retracted positions.

5. A push-button assembly as in claim 3, wherein said push-button assembly includes a cut-out opening which is sized and configured to allow said push-button assembly to straddle said support web.

6. A push-button assembly as in claim 3, wherein said support web includes a protruding ring surrounding said guide aperture, said ring being inserted within a lower end of said spring.

7. A push-button assembly as in claim 1, wherein said housing includes a bottom wall, and a generally cylindrical seat protruding upwardly from said bottom wall, said seat being sized and configured so as to accept therewithin a lower end of said spring.

8. A push-button assembly as in claim 1, wherein said push-button assembly includes at least one pair of lock tabs, and wherein said housing includes recesses defined in the side walls in opposition to said lock tabs, each said recesses having an upper edge stop against which said lock tab contacts when said push-button assembly is in said extended position.

* * * * *

UNITED STATES PATENT AND TRADEMARK OFFICE

CERTIFICATE OF CORRECTION

PATENT NO. : 5,201,410

DATED : April 13, 1993

INVENTOR(S) : Tsunesuke Takano, et al.

It is certified that error appears in the above-indentified patent and that said Letters Patent is hereby corrected as shown below:

Column 6, line 30, between the word "and" and "including" the following words should read --retracted positions, said push-button--.

Column 6, lines 33-34, should be deleted.

Column 6, line 44, "pair of" should be deleted.

Signed and Sealed this

Twenty-ninth Day of March, 1994

*Attest:*

Bruce Lehman

BRUCE LEHMAN

*Attesting Officer*

*Commissioner of Patents and Trademarks*